US006859943B1

(12) United States Patent
Wallace, III

(10) Patent No.: US 6,859,943 B1
(45) Date of Patent: Mar. 1, 2005

(54) PADDED FISHING SHORTS

(76) Inventor: William J. Wallace, III, 744 Burlwood St., Brandon, FL (US) 33511

( * ) Notice: Subject to any disclaimer, the term of this patent is extended or adjusted under 35 U.S.C. 154(b) by 0 days.

(21) Appl. No.: 10/621,021

(22) Filed: Jul. 16, 2003

(51) Int. Cl.[7] ..... A41D 1/06
(52) U.S. Cl. ..... 2/228; 2/267
(58) Field of Search ..... 2/22, 24, 408, 2/227, 228, 238, 267, 23, 455, 466, 94, 464, 244, 908; 215/399; 224/148.6, 250, 158, 182, 194, 922; 36/132, 139; 446/26, 28; 248/312, 683, 313, 690; 206/557, 564; D22/147; 43/21.1

(56) References Cited

U.S. PATENT DOCUMENTS

| | | | | | |
|---|---|---|---|---|---|
| 3,153,791 | A | * | 10/1964 | White | 2/460 |
| 4,035,844 | A | * | 7/1977 | Atack et al. | 2/466 |
| 4,258,440 | A | * | 3/1981 | McGowan | 2/114 |
| 4,630,319 | A | * | 12/1986 | Mathis | 2/250 |
| 4,811,427 | A | * | 3/1989 | Regan | 2/466 |
| 4,817,323 | A | * | 4/1989 | Braid | 43/21.2 |
| 4,955,572 | A | * | 9/1990 | Simmons | 248/312 |
| 5,052,052 | A | * | 10/1991 | Gilford et al. | 2/467 |
| 5,054,127 | A | * | 10/1991 | Zevchak | 2/247 |
| 5,119,979 | A | * | 6/1992 | Kallman | 224/250 |
| 5,134,726 | A | * | 8/1992 | Ross | 2/465 |
| 5,271,101 | A | * | 12/1993 | Speth et al. | 2/228 |
| 5,381,922 | A | * | 1/1995 | Gladman et al. | 220/481 |
| 5,497,511 | A | * | 3/1996 | Zade | 2/22 |
| 5,551,082 | A | * | 9/1996 | Stewart et al. | 2/465 |
| 5,592,689 | A | * | 1/1997 | Matthews | 2/23 |
| 5,636,377 | A | * | 6/1997 | Wiener | 2/465 |
| 5,689,836 | A | * | 11/1997 | Fee et al. | 2/465 |
| 5,742,939 | A | * | 4/1998 | Williams | 2/69 |
| 5,799,328 | A | * | 9/1998 | Harlem et al. | 2/69 |
| 5,909,802 | A | * | 6/1999 | Puco et al. | 2/102 |
| 6,014,771 | A | * | 1/2000 | Kirven | 2/23 |
| 6,023,789 | A | * | 2/2000 | Wilson et al. | 2/228 |
| 6,041,436 | A | * | 3/2000 | Keen | 2/69 |
| 6,041,441 | A | * | 3/2000 | Counts et al. | 2/227 |
| 6,041,447 | A | * | 3/2000 | Endler | 2/455 |
| 6,182,297 | B1 | * | 2/2001 | Duren et al. | 2/228 |
| 6,256,789 | B1 | * | 7/2001 | Young et al. | 2/69 |
| 6,353,932 | B2 | * | 3/2002 | Stembridge | 2/69 |
| 6,408,446 | B1 | * | 6/2002 | Carrington | 2/465 |
| 6,434,749 | B1 | * | 8/2002 | Grounds et al. | 2/2.15 |
| 6,457,616 | B2 | * | 10/2002 | Gagne | 224/148.4 |
| 6,519,780 | B2 | * | 2/2003 | Goodwin | 2/267 |
| 6,532,599 | B1 | * | 3/2003 | Dugan | 2/228 |
| 6,715,158 | B1 | * | 4/2004 | Hay | 2/456 |
| 2002/0046984 | A1 | * | 4/2002 | Cheatwood | 215/399 |

FOREIGN PATENT DOCUMENTS

| | | | | |
|---|---|---|---|---|
| CA | 2410383 | A1 | * 5/2004 | A45F/3/16 |

OTHER PUBLICATIONS

Redhead, Fall 2001, Hunting Specialists Catalog, Bass Pro Shops, p. 172, Buddy–lok Accessories.*

* cited by examiner

*Primary Examiner*—John J. Calvert
*Assistant Examiner*—Alissa L. Hoey

(57) ABSTRACT

A pair of shorts with a padding attached to the outside over the crotch and lower abdomen area so the wearer can rest the butt of a fishing pole on their abdomen in the customary position used for fighting fish. The padded fishing shorts can also be made to where the padding is attached to the frontal crotch area by means of hook and loop material attachment strips. Also, the shorts can be provided with an attachment tang by which a drink koozie can be attached to the shorts so a fisherman can have both hands free to reel in a fish.

1 Claim, 4 Drawing Sheets

PADDED FISHING SHORTS

BACKGROUND OF THE INVENTION

1. Field of the Invention

The present invention relates to padded fishing shorts for use in connection with deep sea fishing, lake, pond, and river fishing, and other related sports. The padded fishing shorts have particular utility in connection with comfortably resting a fishing pole butt on the wearer's abdomen atop exterior removable padding, and for storing a drink koozie on a clip.

2. Description of the Prior Art

Padded fishing shorts are desirable to increase a fisherman's comfort as they are fighting a fish by allowing the fisherman to rest the butt of their fishing rod against their abdomen.

The use of padded sports clothing is known in the prior art. For example, U.S. Pat. No. 5,134,726 to Ross discloses a sports pant with openable and closeable pockets on the interior of the pants for receiving padding. However, the Ross '726 patent does not disclose attaching the padding by hook and loop material, e.g. VELCRO™, and has further drawbacks of having to open the pants to remove the padding.

U.S. Pat. No. 4,922,899 to Graffet al. discloses an athletic cup apparatus that has two protective cups on an apparatus attached with elastic straps. However, the '899 patent does not disclose the use of soft padding attached to the wearers clothing, and additionally does not provide for a single layer of soft padding suitable for fishing, but rather provides for a flange holding a rigid cup and a non-rigid cup.

Additionally, U.S. Pat. No. 5,381,922 to Gladman et al. discloses a no handle drink carrier that attaches to a belt clip with a hook and loop material, e.g. VELCRO™. However, the '922 patent does not provide means for attaching drink carrier to the shorts, which will free up the belt for various fishing implements, and has the additional deficiency of attaching the drink carrier with a hook and loop rnaterial, e.g. VELCRO™, which will not provide reliable support when a drink can is full.

Lastly, U.S. Pat. No. 4,577,346 to Hall discloses a protective sports garment that has a plurality of flat ring that extend around the wearer in the waist area However, the Hall '346 patent does not provide for a padded garment that is integrated with a pair of shorts, and can not allow the user to remove the padding on all sides to allow for padding only in the lower abdomen area where a fishing pole butt will rest.

While the above-described devices fulfill their respective, particular objectives and requirements, the aforementioned patents do not describe a padded fishing shorts that allows comfortably resting a fishing pole butt on the wearer's abdomen atop exterior removable padding, and for storing a drink koozie on a clip. The Ross patent makes no provision for an exterior removable padding or a drink koozie clip, both of which are desirable for convenience and comfort while fishing.

Therefore, a need exists for a new and improved padded fishing shorts that can be used for comfortably resting a fishing pole butt on the wearer's abdomen atop exterior removable padding, and for storing a drink koozie on a clip. In this regard, the present invention substantially fulfills this need. In this respect, the padded fishing shorts according to the present invention substantially departs from the conventional concepts and designs of the prior art, and in doing so provides an apparatus primarily developed for the purpose of comfortably resting a fishing pole butt on the wearer's abdomen atop exterior removable padding, and for storing a drink koozie on a clip.

SUMMARY OF THE INVENTION

In view of the foregoing disadvantages inherent in the known types of padded sports clothing now present in the prior art, the present invention provides an improved padded fishing shorts, and overcomes the above-mentioned disadvantages and drawbacks of the prior art. As such, the general purpose of the present invention, which will be described subsequently in greater detail, is to provide a new and improved padded fishing shorts which has all the advantages of the prior art mentioned heretofore and many novel features that result in a padded fishing shorts which is not anticipated, rendered obvious, suggested, or even implied by the prior art, either alone or in any combination thereof.

To attain this, the present invention essentially comprises a pair of shorts with a trunk portion and legs, with a padding attached to the outside of the frontal crotch area of the shorts, such that the padding is covering a wearers crotch area and lower abdomen and the wearer can rest the butt of a fishing pole on their abdomen in the customary position used for fighting fish. This will prevent bruising and chaffing that typically happens while fighting or reeling in a fish.

The padded fishing shorts can also be made to where the padding is attached to the frontal crotch area by means of hook and loop attachment strips, with one side of strips attached to the exterior surface of the frontal crotch area and the other side of the strips attached to the back of the padding. Also, the shorts can be provided with an attachment tang present on the hip or leg area of the shorts, by which a drink koozie can be attached to the shorts by means of a clip on the side of the koozie, so a fisherman can drink from the koozie and then attach it to the tang and have both hands free to reel in a fish.

There has thus been outlined, rather broadly, the more important features of the invention in order that the detailed description thereof that follows may be better understood and in order that the present contribution to the art may be better appreciated.

The invention may feature a pad made of neoprene, rubber, foam, or any other soft padding material. Also, the shorts can be made of nylon, spandex, cotton, or other materials typically used for sports clothing. Finally, the drink koozie can be foam or other insulating material typically used for drink holders, and the attachment clip and tang can be made of hard plastic, metal, or other rigid material. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved padded fishing shorts that has all of the advantages of the prior art padded sports clothing and none of the disadvantages.

It is another object of the present invention to provide a new and improved padded fishing shorts that may be easily and efficiently manufactured and marketed.

An even further object of the present invention is to provide a new and improved padded fishing shorts that has a low cost of manufacture with regard to both materials and labor, and which accordingly is then susceptible of low prices of sale to the consuming public, thereby making such padded fishing shorts economically available to the buying public.

Still another object of the present invention is to provide a new padded fishing shorts that provides in the apparatuses and methods of the prior art some of the advantages thereof, while simultaneously overcoming some of the disadvantages normally associated therewith.

Even still another object of the present invention is to provide a padded fishing shorts for comfortably resting a fishing pole butt on the wearer's abdomen atop exterior removable padding, and for storing a drink koozie on a clip. This allows the user to dispense with any bulky belt-mounted fishing pole cups and comfortably rest the fishing pole on their abdomen when reeling in a fish. Also, the user can avoid spilling their drink by clipping in onto the tang so it doesn't get knocked over while fighting the fish.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
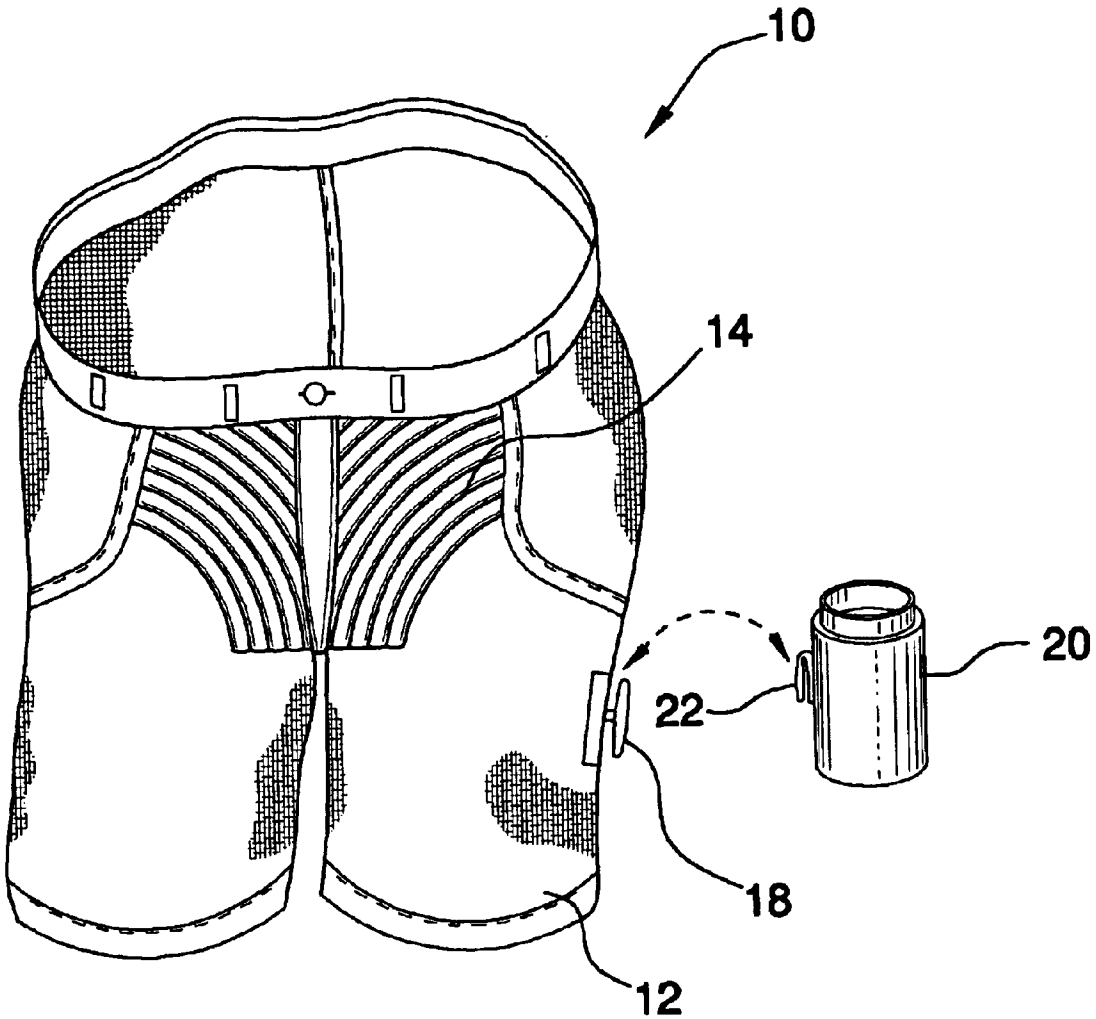
FIG. 1 is an elevated front view of the present preferred embodiment of the padded fishing shorts constructed in accordance with the principles of the present invention.

Referring now to the drawings, and particularly to FIG. 1, a preferred embodiment of the padded fishing shorts of the present invention is shown and generally designated by the reference numeral 10.

In FIG. 1, a new and improved padded fishing shorts 10 of the present invention for resting a fishing pole on the user's abdomen is illustrated and will be described. More particularly, the padded fishing shorts 10 has a pair of shorts 12, on which is connected a padding 14. The padding 14 is thick enough to prevent abrasion when subjected to the forces present when a fishing pole is propped against the pad the user fights and reels in a fish. Also, the coverage of the padding 14 is approximately down to the inseam of the shorts 12, up to the top edge, and sideways to the pocket openings. Additionally, the size of the padding 14 will vary with the size of shorts sold for different users, such as children or larger men. The shorts 12 are provided with a tang 18, which is connected on one side, usually by sewing it into the shorts 12. Also the shorts 12 are provided with a koozie 20 of size needed to hold a standard can or bottle. The koozie 20 has a clip 22 on the side by which it can be hung or attached to the tang 18 on the shorts 12.

Figure 2:
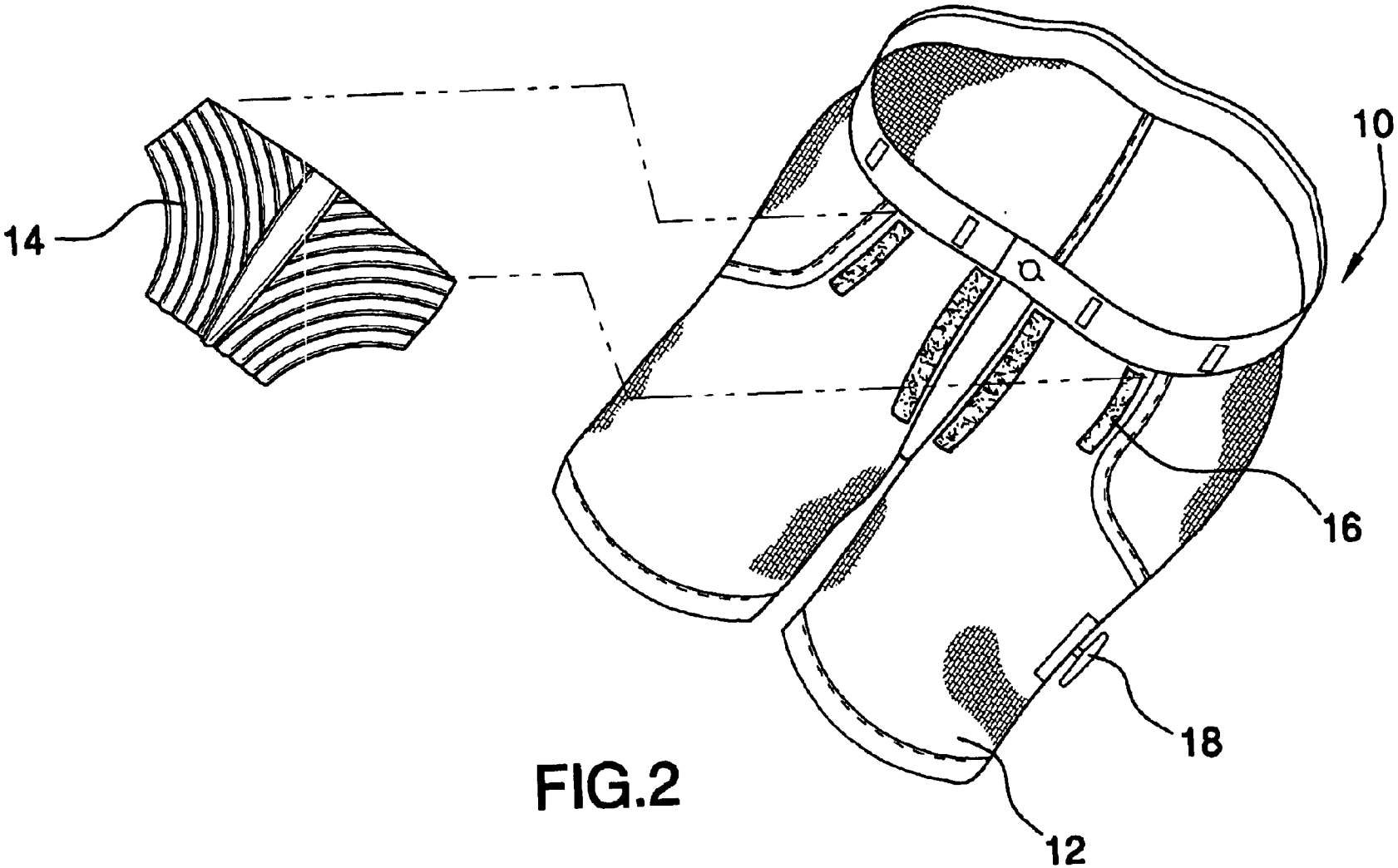
FIG. 2 is an elevated view of the padded fishing shorts of the present invention, with the hook-and-loop-attached padding removed.

Referring now to FIG. 2, the invention is shown with the padding 14 in its removable form, the padding being detached from the shorts 12. Hook and loop material attachment strips 16 are provided, attached to the front of the shorts 12 by sewing, tape, or other attachment means. As expected, the hook and loop surface matches to the opposite side hook and loop surface (not shown) on back of the padding 14. This opposite side hook and loop material can be configured in matching strips, or it can cover the entire back of the padding 14 to allow for easier placement and attachment.

Figure 3:
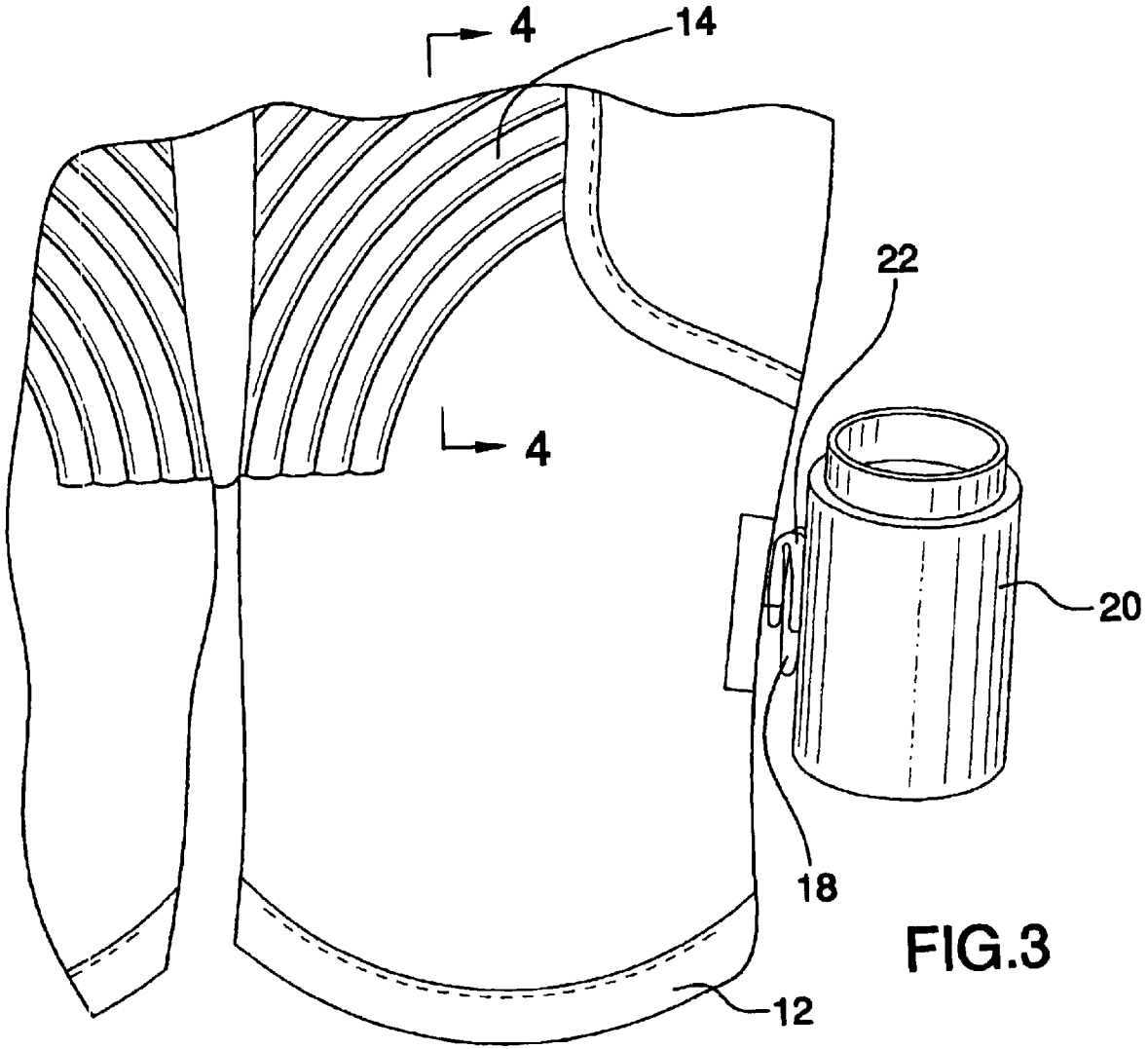
FIG. 3 is a front view of the padded fishing shorts of the present invention with the drink koozie attached.

Now Referring to FIG. 3, the invention is shown with the koozie 20 attached to the shorts 12. This is accomplished by means of the clip 22, which clips onto the tang 18.

Figure 4:
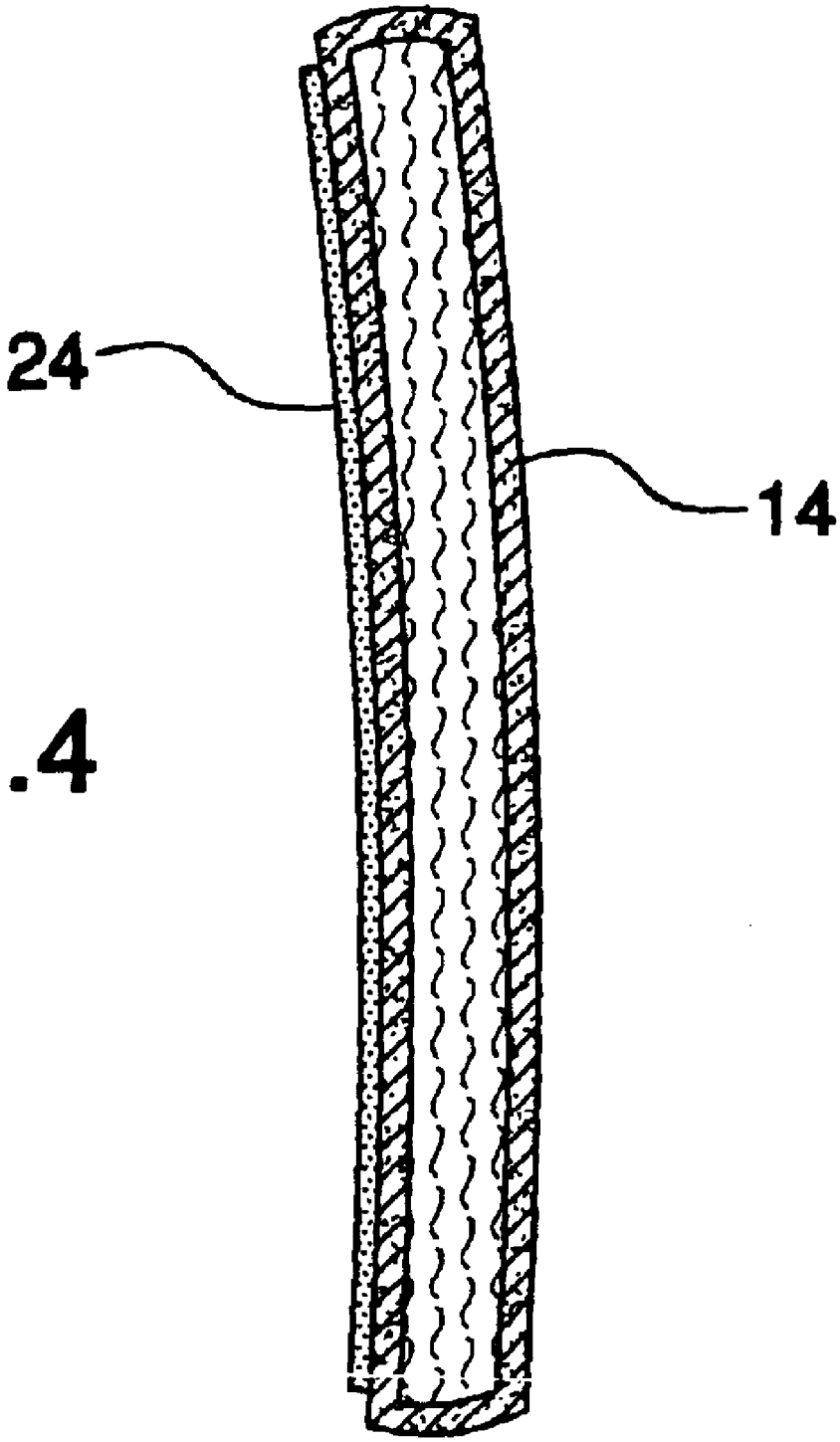
FIG. 4 is a cross section view of the padding taken along the line 4 in FIG. 3.

Referring finally to FIG. 4, a cross section of the padding 14 is shown, and the opposite side hook and loop material 24 can be seen on the back.

In use, it can now be understood that the user will wear the shorts 12, with the padding 14 attached, while fishing. Then, in the embodiment with removable padding, the user can remove the padding 14 for other wear. When the user gets a fish to bite and needs to reel it in, they will prop the fishing pole on the padding 14 and use the typical fishing grip with one had grasping the pole and the other had operating the reel. In this position, the butt of the fishing pole will rest against the abdomen of the user on top of the padding 14, and the user should be shielded from uncomfortable scraping and bruising. Also, as fishing enthusiasts usually like to have a drink while waiting for a fish to bite, the user can put their drink in the koozie 20, and then attach it to the tang 18 by sliding the clip 22 over the top of the tang. The user can then stand to reel in their fish, and when they are done the koozie 20 can be removed by sliding it upward off of the tang 18.

While a preferred embodiment of the padded fishing shorts has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable padding material such as rubber, foam, or a stuffed cushion of mixed materials may be used instead of the neoprene padding 14 described. Also, the shorts 12 can be made of nylon, cotton, or similar material. Note also that the invention can be embodied as a retrofit kit for attaching the padding 14 and koozie 20 with accessories to a pair of shorts. And although comfortably resting a fishing pole butt on the wearer's abdomen atop exterior removable padding, and storing a drink koozie on a clip have been described, it should be appreciated that the padded fishing shorts herein described is also suitable for any other sports or labor application where the wearer needs padding only in a specific area. Additionally, the padding 12 and the tang 18 can be attached to the shorts by sewing, glue, hook and loop material, e.g. VELCRO™, or other attachment means. Finally, the shorts 12 can be secured about the user's waist by any number of means, including a tie-cord, snap, button, belt loops, or combination thereof.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. Padded fishing shorts comprising:

a trunk portion and legs, said trunk portion having an open top with means for securement about the waist of a wearer, a rear area for covering the buttocks of the wearer, a frontal crotch area, and opposite sides forming hip areas for covering the hips of a wearer, said trunk portion and said trunk portion and said legs having exterior surfaces;

a plurality of hook and loop material strips attached to said exterior surface of said frontal crotch area, an attachment tang present on one of said hip areas or one of said legs;

a drink koozie, having a clip, said drink koozie being attached to said attachment tang by means of said clip, said drink koozie being capable of being removed from said attachment tang such that the wearer can drink from said koozie and then attach said koozie to said attachment clip to have both hands free for fishing; and a padding attached to said exterior surface of said frontal crotch area by means of said hook and loop material strips, said padding being capable of covering a wearer's crotch area and lower abdomen such that the wearer can rest the butt of a fishing pole on their abdomen in the customary position used for fighting fish, said padding being removable from said shorts for convenience.

* * * * *